US010353328B2

(12) United States Patent
Kondo

(10) Patent No.: US 10,353,328 B2
(45) Date of Patent: Jul. 16, 2019

(54) FIXING DEVICE AND IMAGE FORMING APPARATUS

(71) Applicant: KYOCERA Document Solutions Inc., Osaka (JP)

(72) Inventor: Akihiro Kondo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/139,328

(22) Filed: Sep. 24, 2018

(65) Prior Publication Data

US 2019/0171139 A1 Jun. 6, 2019

(30) Foreign Application Priority Data

Dec. 4, 2017 (JP) ..... 2017-232440

(51) Int. Cl.
*G03G 15/20* (2006.01)
*G03G 15/16* (2006.01)

(52) U.S. Cl.
CPC ..... *G03G 15/2053* (2013.01); *G03G 15/16* (2013.01); *G03G 15/2064* (2013.01)

(58) Field of Classification Search
CPC . G03G 15/16; G03G 15/2053; G03G 15/2064
See application file for complete search history.

(56) References Cited

U.S. PATENT DOCUMENTS

2008/0310866 A1* 12/2008 Kim ..... G03G 15/2064 399/33
2009/0016760 A1* 1/2009 Hachisuka ..... G03G 15/2039 399/69

FOREIGN PATENT DOCUMENTS

JP 2008-233133 A 10/2008
JP 2010-127996 A 6/2010
JP 2010-211080 A 9/2010
JP 2017-111188 A 6/2017

* cited by examiner

*Primary Examiner* — Gregory H Curran
(74) *Attorney, Agent, or Firm* — Studebaker & Brackett PC

(57) ABSTRACT

A fixing device includes an elastic fixing roller, an endless belt, a pressing roller and a stretching part. The endless fixing belt is wound around the fixing roller with play. The pressing roller presses the fixing roller via the fixing belt to deform the fixing roller and forms a pressing area between the pressing roller and the fixing belt. A sheet passes through the pressing area. The stretching part is configured to pull the fixing belt in a direction opposite to the pressing roller and to stretch the fixing belt when a conveyance speed of the sheet conveyed to the pressing area is slower than a reference conveyance speed. The stretching part is configured to restrain deformation of the fixing roller to the pressing roller and to shorten length of the pressing area along a conveyance direction of the sheet.

3 Claims, 5 Drawing Sheets

FIXING DEVICE AND IMAGE FORMING APPARATUS

INCORPORATION BY REFERENCE

This application is based on and claims the benefit of priority from Japanese Patent application No. 2017-232440 filed on Dec. 4, 2017, which is incorporated by reference in its entirety.

BACKGROUND

The present disclosure relates to a fixing device to fix a toner image on a sheet and an image forming apparatus including the fixing device.

An image forming apparatus, such as a laser printer, is provided with a fixing device configured to fix a toner image on a sheet. The fixing device includes a fixing belt and a pressing roller. The fixing belt is wound around a fixing roller, and the pressing roller is pressed against the fixing roller via the fixing belt to form a pressing area between the pressing roller and the fixing belt. When the sheet is passed through the pressing area, the toner image is fixed on the sheet.

By the way, in the image forming apparatus, when a thick paper or a rough paper is passed through the pressing area, a conveyance speed of the sheet may be set to be slower than a reference conveyance speed in order to keep a fixing performance constant. On the other hand, even when a plain paper is passed through the pressing area, the conveyance speed of the sheet may be set to be slower than the reference conveyance speed in order to increase resolution of the image or to reduce noise. In this case, different from the former case, because a sufficient fixing performance is provided at the reference conveyance speed, it is required to change a fixing condition. For example, a fixing temperature may be decreased or a fixing pressure may be decreased to shorten a length of the pressing area along the conveyance direction and to shorten a time (a passing time) required for the sheet to pass through the pressing area.

However, in the case where the fixing temperature is decreased, a waiting time until the fixing temperature is decreased sufficiently is generated, and a productivity of the fixing operation may be lowered. Additionally, because the time required for the sheet to pass through the pressing area becomes longer than that at the reference conveyance time, glossiness of the image tends to be high under a condition where the fixing performance suitable for the reference conveyance speed is provided, and an image quality may be unstable.

On the other hand, in the case where the fixing pressure is decreased to shorten the length of the pressing area and to shorten the passing time, the following problem may occur. It will be described with reference to FIG. 4. FIG. 4 is a graph showing a relationship between the fixing pressure, and the length of the pressing area and a linear pressure in the pressing area. In the graph, the horizontal axis shows the fixing pressure (N), the left side vertical axis shows the length of the pressing area (mm) and the right side vertical axis shows the linear pressure (N/mm) in the pressing area. The linear pressure is obtained by dividing the fixing pressure by the length of the pressing area.

At the reference conveyance speed, when it is assumed that the fixing pressure is 200 N and the length of the pressing area is 8 mm, the linear pressure is 25 N/mm. When the conveyance speed is decreased to one half of the reference conveyance speed, in order to keep the passing time constant, it is required to set the length of the pressing area to 4 mm. Then, the fixing pressure is about 50 N and the linear pressure is about 12.5 N/mm which is one half of that at the reference conveyance speed. When the fixing pressure is decreased such that the passing time is the same as that at the reference conveyance speed, the linear pressure is also decreased. When the linear pressure is low, the glossiness of the image tends to be lower. Therefore, it is difficult to provide the same fixing performance as that at the reference conveyance speed because the stable image quality cannot be obtained.

When the conveyance speed is decreased, the fixing pressure may be adjusted so as to make the passing time slightly longer than that at the reference conveyance speed and to make the linear pressure slightly lower and the fixing temperature may be adjusted. However, it is difficult to provide the same fixing condition as that at the reference conveyance speed and to solve the above problems regarding the image quality and the productivity.

In some cases, the fixing device capable of changing the pressure of the pressing area may be provided with a soft or hard pad which presses the pressing belt to the heating roller or a pressing member which presses the fixing belt toward the sheet conveying path. Alternatively, a movable pressing part which comes into pressure contacts with the fixing belt or a nip shape changing part which changes the tension of the fixing belt may be provided.

However, the above fixing devices are configured to change the pressure of the pressing area depending on the type of the sheet or the desirable glossiness; and are not applied to change the pressure of the pressing area depending on the decreased conveyance speed when the plain paper is passed through the pressing area.

SUMMARY

In accordance with an aspect of the present disclosure, a fixing device includes an elastic fixing roller, an endless belt, a pressing roller and a stretching part. The endless fixing belt is wound around the fixing roller with play. The pressing roller presses the fixing roller via the fixing belt to deform the fixing roller and forms a pressing area between the pressing roller and the fixing belt. A sheet passes through the pressing area. The stretching part is configured to pull the fixing belt in a direction opposite to the pressing roller and to stretch the fixing belt when a conveyance speed of the sheet conveyed to the pressing area is slower than a reference conveyance speed. The stretching part is configured to restrain deformation of the fixing roller to the pressing roller and to shorten length of the pressing area along a conveyance direction of the sheet.

In accordance with an aspect of the present disclosure, an image forming apparatus includes an image forming part and the fixing device. The image forming part is configured to form a toner image on a sheet. The fixing device is configured to fix the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus and a fixing device of the present disclosure will be described.

Figure 1:
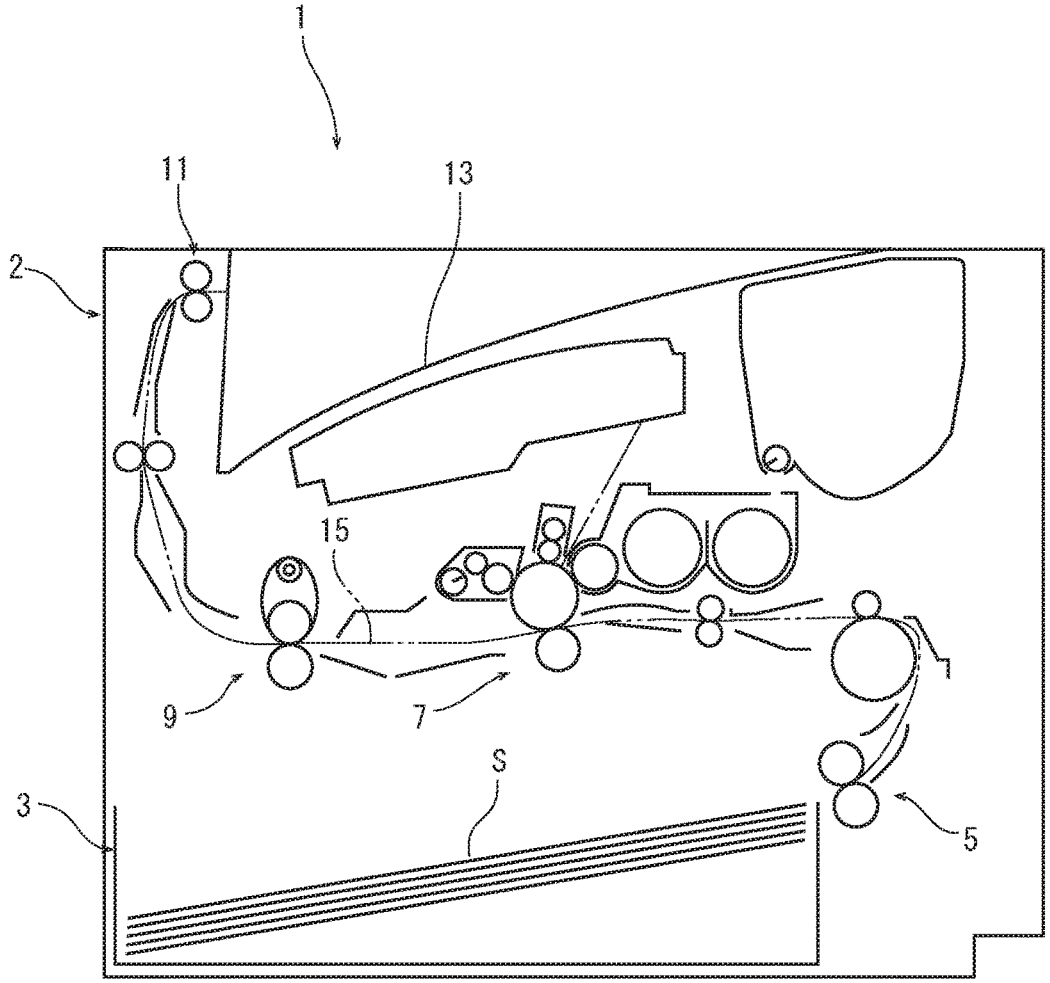
FIG. 1 is a front view schematically showing an inner structure of a printer according to one embodiment of the present disclosure.

First, with reference to FIG. 1, an entire structure of a printer as an image forming apparatus will be described. FIG. 1 is a front view showing an inner structure of the printer.

An apparatus main body 2 of the printer 1 is provided with a sheet feeding cassette 3 storing a sheet S, a sheet feeding device 5 feeding the sheet S from the sheet feeding cassette 3, an image forming part 7 forming a toner image on the sheet S, a fixing device 9 fixing the toner image on the sheet S, an ejecting device 11 ejecting the sheet S and an ejected sheet tray 13 on which the ejected sheet S is stacked. In the apparatus main body 2, a conveying path 15 for the sheet S is formed so as to extend from the sheet feeding device 5 to the ejecting device 11 through the image forming part 7 and the fixing device 9.

The sheet S is fed by the sheet feeding device 5 from the sheet feeding cassette 3, and conveyed along the conveying path 15 to the image forming part 7. At the image forming part 7, the toner image is formed on the sheet S. The sheet S is conveyed along the conveying path 15 to the fixing device 9. The fixing device 9 fixes the toner image on the sheet S. The sheet S on which the toner image is fixed is ejected from the ejecting device 11 and then stacked on the ejected sheet tray 13.

Figure 2:
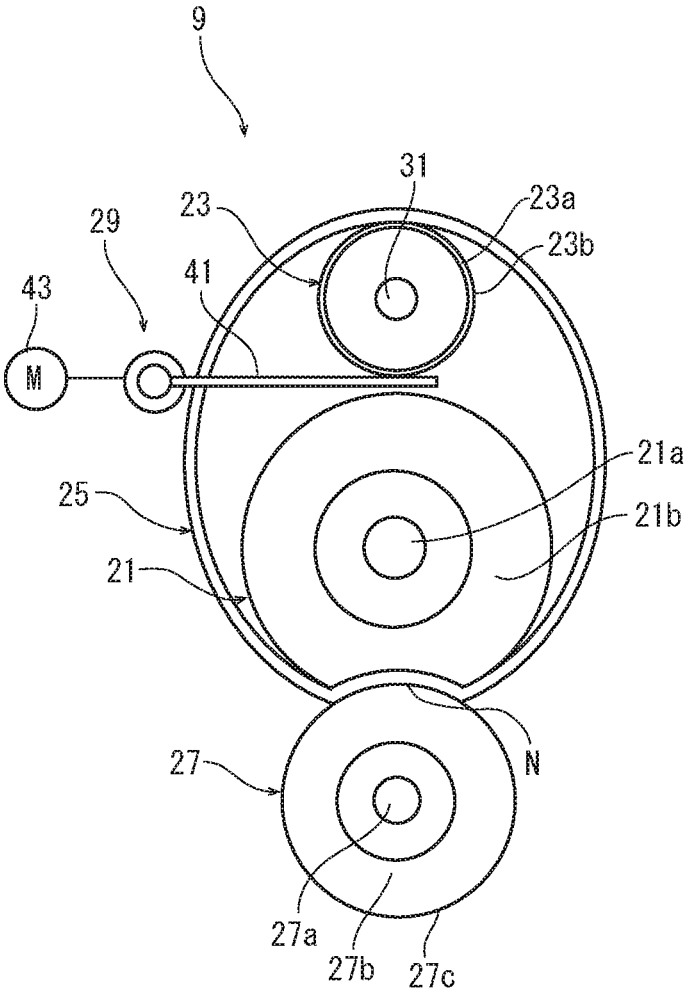
FIG. 2 is a sectional view schematically showing a fixing device (at a reference conveyance speed) according to the embodiment of the present disclosure.
Figure 3:
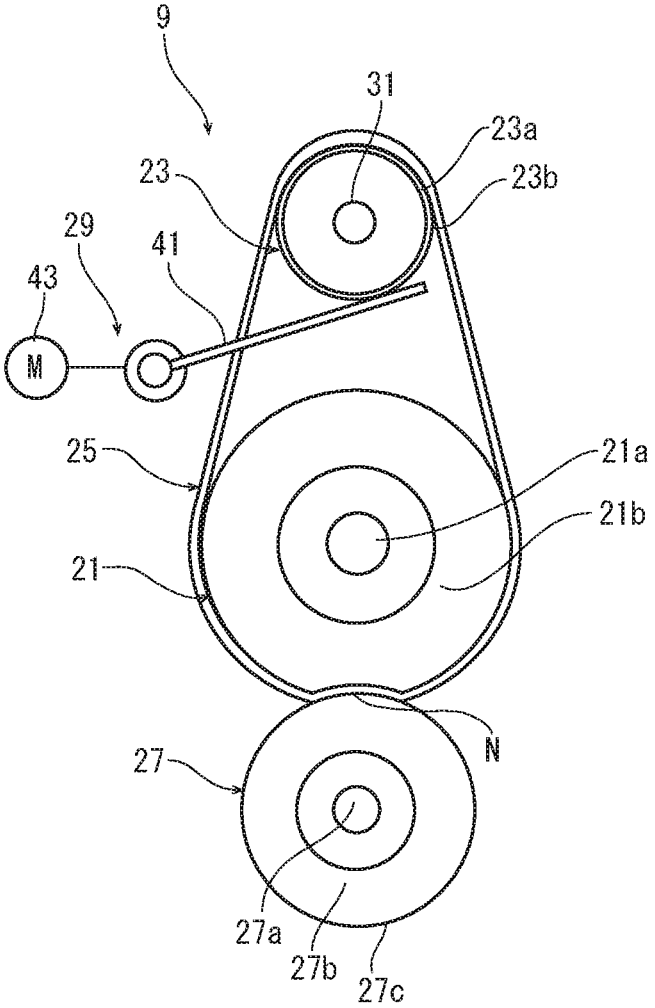
FIG. 3 is a sectional view schematically showing the fixing device (at a decreased conveyance speed) according to the embodiment of the present disclosure.

With reference to FIG. 2 and FIG. 3, the fixing device 9 will be described. FIG. 2 is a sectional view showing the fixing device 9 at a reference conveyance speed and FIG. 3 is a sectional view showing the fixing device at a decreased conveyance speed.

The fixing device 9 includes a fixing roller 21, a heating roller 23, an endless fixing belt 25 wound around the fixing roller 21 and the heating roller 23, a pressing roller 27 to be pressed against the fixing roller 21 via the fixing belt 25 and a stretching part 29 pulling the fixing belt 25 in a direction opposite to the pressing roller 27.

The fixing roller 21 includes a columnar core metal 21*a* and an elastic layer 21*b* provided around an outer circumferential face of the core metal 21*a*. The core metal 21*a* is made of iron, for example. The elastic layer 21*b* is made of silicon sponge, for example. The fixing roller 21 is supported in a rotatable manner.

The heating roller 23 includes a cylindrical core metal 23*a* and an outer layer 23*b* provided around an outer circumferential face of the core metal 23*a*. The core metal 23*a* is made of iron, for example. The outer layer 23*b* is made of PTFE, for example. In a hollow space of the heating roller 23, a halogen heater 31 as a heater is stored. The halogen heater 31 radiates radiant heat to an inner circumferential face of the heating roller 23 to heat the heating roller 23. The heating roller 23 is arranged apart from the fixing roller 21, and supported so as to be movable in a direction away from the fixing roller 21.

The fixing belt 25 is an endless belt having an outer diameter larger than an outer diameter of the fixing roller 21. The fixing belt 25 includes abase layer, an elastic layer provided around an outer circumferential face of the base layer and a release layer provided around an outer circumferential face of the elastic layer. The base layer is made of SUS, for example. The elastic layer is made of silicon rubber, for example. The release layer is made of PFA tube, for example. The fixing belt 25 is wound around the fixing roller 21 and the heating roller 23 with play.

The pressing roller 27 includes a core metal 27*a*, an elastic layer 27*b* provided around an outer circumferential face of the core metal 27*a* and a release layer 27*c* provided around an outer circumferential face of the elastic layer 27*b*. The core metal 27*a* is made of SUS, for example. The elastic layer 27*b* is made of silicon rubber, for example. The release layer 27*c* is made of PFA tube, for example. The pressing roller 27 presses the fixing roller 21 via the fixing belt 25, deforms the fixing roller 21 elastically and forms a pressing area N between the pressing roller 27 and the fixing belt 25. The pressing roller 27 is driven by a motor (not shown) to be rotated. The fixing belt 25 is driven by the rotation of the pressing roller 27, and rotated in a direction opposite to a rotation direction of the pressing roller 27.

The stretching part 29 includes a pair of turnable levers 41 and a motor 43 which turns the pair of levers 41. The levers 41 come into contact with both end portions of the heating roller 23 through bearings (not shown) from a side of the fixing roller 21. The motor 43 turns the levers 41 so as to move the heating roller 23 in the direction away from the fixing roller 21. When the levers 41 are turned by the motor 43, as shown in FIG. 3, the heating roller 23 is moved in the direction away from the fixing roller 21, and the fixing belt 25 is stretched between the heating roller 23 and the fixing roller 21. The halogen heater 31 may be moved together with the heating roller 23.

A fixing operation of the fixing device 9 having the above described configuration will be described. First, the pressing roller 27 is driven by the motor to be rotated, and the fixing belt 25 is driven by the pressing roller 27 to be rotated in the direction opposite to the rotation direction of the pressing roller 27. At the same time, the halogen heater 31 is driven to heat the heating roller 23, and the heated heating roller 23 heats the fixing belt 25. The fixing belt 25 is heated to a predetermined control temperature (for example, 160° C.). After the fixing belt 25 is heated in the above manner, the sheet S on which the toner image is transferred is conveyed to the pressing area N. At the pressing area N, the sheet S is conveyed between the fixing belt 25 and the pressing roller 27. At this time, the sheet S is heated by the fixing belt 25 and pressed between the fixing belt 25 and the pressing roller 27. As a result, the toner image is fixed on the sheet S. The sheet S on which the toner image is fixed is conveyed along the conveyance path 15.

By the way, when the sheet S is passed through the pressing area N, in order to improve resolution of the image or to reduce noise, a conveyance speed of the sheet S is sometimes decreased. In such a case, for example, a special mode is selected by an operation part (not shown) provided at the apparatus main body 2. When the special mode is selected, the conveyance speed of the sheet S is adjusted to be one half of a reference conveyance speed, for example. At the same time, in the fixing device 9, the stretching part 29 moves the heating roller 23 in the direction away from the fixing roller 21. Then, the fixing belt 25 is stretched between the heating roller 23 and the fixing roller 21, and the stretched fixing belt 25 restrains deformation of the fixing roller 21 to the pressing roller 27, in other words, the fixing roller 21 is hardly deformed and apparent rigidity of the fixing roller 21 is increased. As a result, a length of the pressing area N along the conveyance direction becomes short when a fixing pressure of the pressing area N is kept constant.

Figure 4:
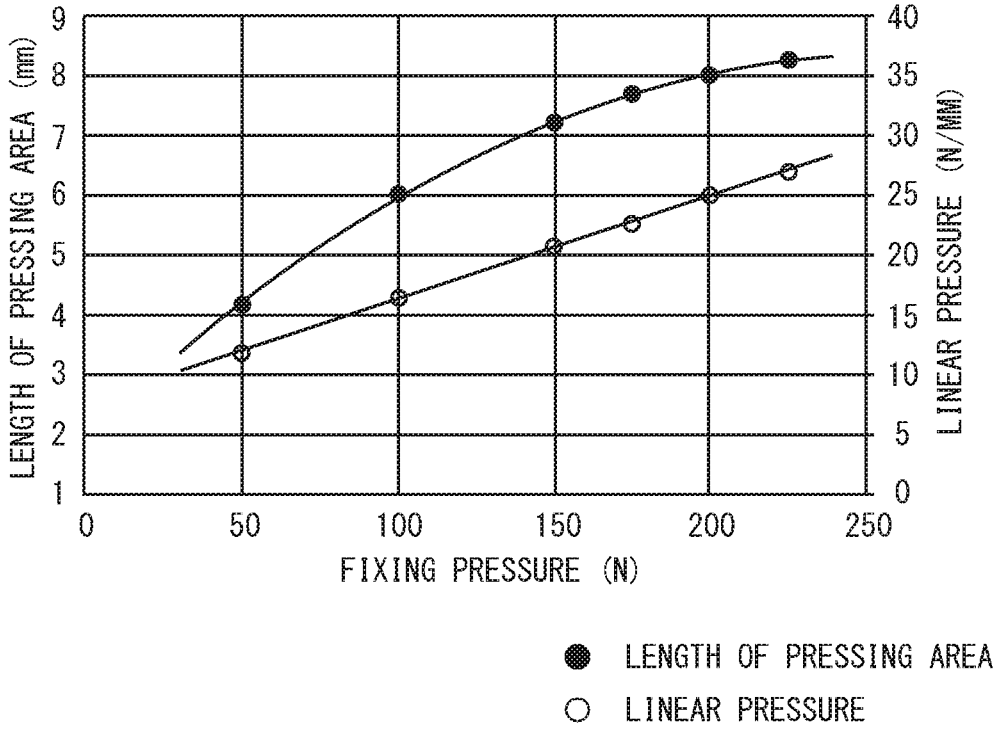
FIG. 4 is a graph showing a relationship between a fixing pressure, and a length of a pressing area and a linear pressure in the pressing area, at the reference conveyance speed, in the fixing device according to the embodiment of the present disclosure.

Next, with reference a graph in FIG. 5 and a graph in FIG. 4, a relationship between the fixing pressure, and the length of the pressing area N and a linear pressure in the pressing area N will be described. In each graph, the horizontal axis shows the fixing pressure (N), the left side vertical axis shows the length of the pressing area (mm) and the right side vertical axis shows the linear pressure in the pressing area (N/mm). The linear pressure (N/mm) is obtained by dividing the fixing pressure (N) by the length (mm) of the pressing area. The fixing pressure is changed by moving the pressing roller 27 in directions close to or away from the fixing roller 21, for example. The graph of FIG. 4 shows the relationship at the reference conveyance speed in the fixing device 9 (refer to FIG. 2). The fixing belt 25 is wound around the heating roller 23 and the fixing roller 21 with the play. When it is assumed that the fixing pressure is 200 N under the state, the length of the pressing area N is 8 mm and the linear pressure is 25 N/mm. When it is assumed that the reference conveyance speed is 200 mm/s, the passing time is obtained by dividing the length of the pressing area (8 mm) by the conveyance speed (200 mm/s) and is 40 ms.

Figure 5:
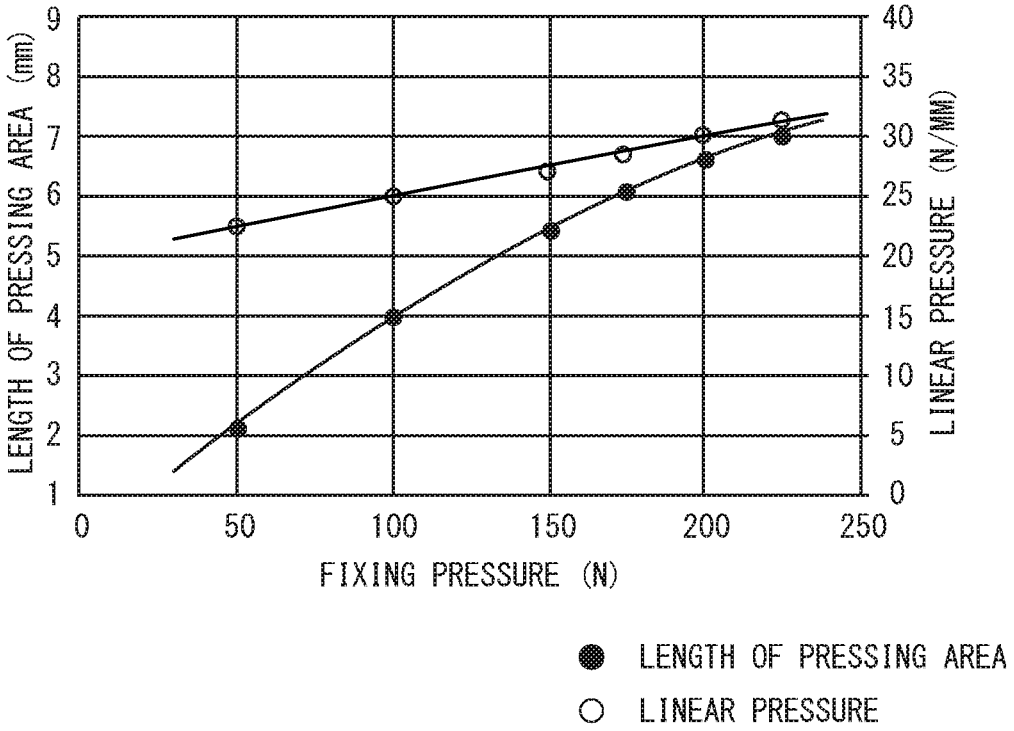
FIG. 5 is a graph showing the relationship between the fixing pressure, and the length of the pressing area and the linear pressure in the pressing area, at the decreased conveyance speed, in the fixing device according to the embodiment of the present disclosure.

The graph of FIG. 5 shows the relationship at one half (100 mm/s) of the reference conveyance speed in the fixing device 9 (refer to FIG. 3). The fixing pressure is decreased to 100 N from 200 N. The fixing belt 25 is stretched by the stretching part 29 to restrain the deformation of the fixing roller 21. As a result, compared with the graph of FIG. 4, the length of the pressing area N at each fixing pressure becomes short, and the linear pressure at each fixing pressure becomes high. For example, when the length of the pressing area N is 4 mm, the linear pressure is 25 N/mm, and the passing time is obtained by dividing the length of the pressing area (4 mm) by the conveyance speed (100 mm/s) and is 40 ms.

As described above, if the conveyance speed is decreased, the linear pressure and the passing time are not changed as compared with those at the reference conveyance speed so that an effect on the fixing performance is the same as that at the reference conveyance speed.

As described above, according to the fixing device 9 of the present disclosure, when the conveyance speed is decreased lower than the reference conveyance speed at the sheet passing, the fixing pressure is decreased and the stretching part 29 stretches the fixing belt 25 to restrain the deformation of the fixing roller 21 to shorten the length of the pressing area N. As a result, the length of the pressing area N at the decreased conveyance speed becomes shorter than that at the reference conveyance speed under the predetermined fixing pressure. For example, as shown in the graphs of FIGS. 4 and 5, in the case of the fixing pressure of 100 N, the length of the pressing area N at the reference conveyance speed is 6 mm; the length of the pressing area at the decreased conveyance speed is 4 mm. In this manner, it becomes possible to shorten the length of the pressing area N under the predetermined fixing pressure and to provide a high linear pressure.

That is, when the conveyance speed is slower than the reference conveyance speed, the fixing pressure is decreased and the stretching part 29 controls force for pulling the fixing belt 25 to shorten the length of the pressing area N such that the time required for the sheet to pass through the pressing area N and the linear pressure in the pressing area N are the same as those at the reference conveyance speed.

As a result, if the conveyance speed is slower than the reference conveyance speed, it becomes possible to provide the same fixing performance as that at the reference conveyance speed. In this case, it is not required to change the fixing temperature so that the waiting time is not generated and the productivity of the fixing operation is not affected. Additionally, the glossiness of the image is not changed and the image failure does not occur.

The configuration of the stretching part 29 is not limited to the embodiment. For example, the heating roller 23 may be moved by using a cam or a solenoid. Alternately, when an IH coil, in place of the heating roller 23, is used as a heat source for heating the fixing belt 25, the fixing belt 25 is wound around the fixing roller and a tension roller and the stretching part 29 may move the tension roller away from the fixing roller 21.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A fixing device comprising:

an elastic fixing roller;

an endless fixing belt wound around the fixing roller with play;

a pressing roller pressing the fixing roller via the fixing belt to deform the fixing roller and forming a pressing area between the pressing roller and the fixing belt, a sheet passing through the pressing area; and a stretching part configured to pull the fixing belt in a direction opposite to the pressing roller and to stretch the fixing belt when a conveyance speed of the sheet conveyed to the pressing area is slower than a reference conveyance speed, the stretching part configured to restrain deformation of the fixing roller to the pressing roller and to shorten length of the pressing area along a conveyance direction of the sheet and to decrease a fixing pressure of the pressing area, wherein the stretching part controls force for pulling the fixing belt to shorten the length of the pressing area along the conveyance direction such that a time required for the sheet to pass through the pressing area (the time is obtained by dividing the length of the pressing area by the conveyance speed of the sheet) and a linear pressure in the pressing area (the linear pressure is obtained by dividing a fixing pressure of the pressing area by the length of the pressing area) are the same as those at the reference conveyance speed.

2. The fixing device according to claim 1, comprising a heater configured to heat the fixing belt, wherein the heater heats the fixing belt to a predetermined temperature regardless of the conveyance speed of the sheet.

3. An image forming apparatus comprising:

an image forming part configured to form a toner image on a sheet; and the fixing device, according to claim 1, configured to fix the toner image on the sheet.

* * * * *